US005720311A

United States Patent [19]

Lin et al.

[11] Patent Number: 5,720,311

[45] Date of Patent: Feb. 24, 1998

[54] TELESCOPIC UMBRELLA SHAFT MEANS WITH CONCAVE HEXAGONAL SIDES

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 839,769

[22] Filed: Apr. 15, 1997

Related U.S. Application Data

[63] Continuation-in-part of Ser. No. 725,823, Oct. 7, 1996, abandoned.

[51] Int. Cl.[6] ..... A45B 19/00

[52] U.S. Cl. ..... 135/25.1; 135/25.4; 135/75

[58] Field of Search ..... 135/25.1, 25.4, 135/37, 75, 141, 19, 22, 24

[56] References Cited

U.S. PATENT DOCUMENTS

| | | | |
|---|---|---|---|
| 2,165,967 | 7/1939 | Haupt | 135/75 X |
| 4,687,012 | 8/1987 | Schultes et al. | 135/75 |
| 5,178,174 | 1/1993 | Wu | 135/25.4 X |
| 5,267,583 | 12/1993 | Wu | 135/25.1 X |
| 5,505,222 | 4/1996 | Lin et al. | 135/37 X |

FOREIGN PATENT DOCUMENTS

| | | | |
|---|---|---|---|
| 0012062 | of 1914 | United Kingdom | 135/25.4 |

*Primary Examiner*—Lanna Mai

[57] ABSTRACT

A telescopic umbrella shaft includes at least an inner tube, and an outer tube telescopically slidably engageable with the inner tube, with each tube having a cross section of hexagonal shape consisting of six arcuate rectangular sides each arcuate rectangular side concaved inwardly towards a longitudinal axis of the shaft, and every two neighboring arcuate rectangular sides converging to form a reinforcing rib convex outwardly from the longitudinal axis, with each reinforcing rib formed as an inversed-U shape and having a longitudinal strip defining a horizontal plane perpendicular to a normal line between the longitudinal axis and an apex intersected by the two neighboring arcuate rectangular sides of the tube, thereby forming a balanced moment of inertia of the concave and convex portions of the tube when dynamically rotating the central shaft for greatly enhancing the stability and strength of the umbrella shaft.

2 Claims, 3 Drawing Sheets

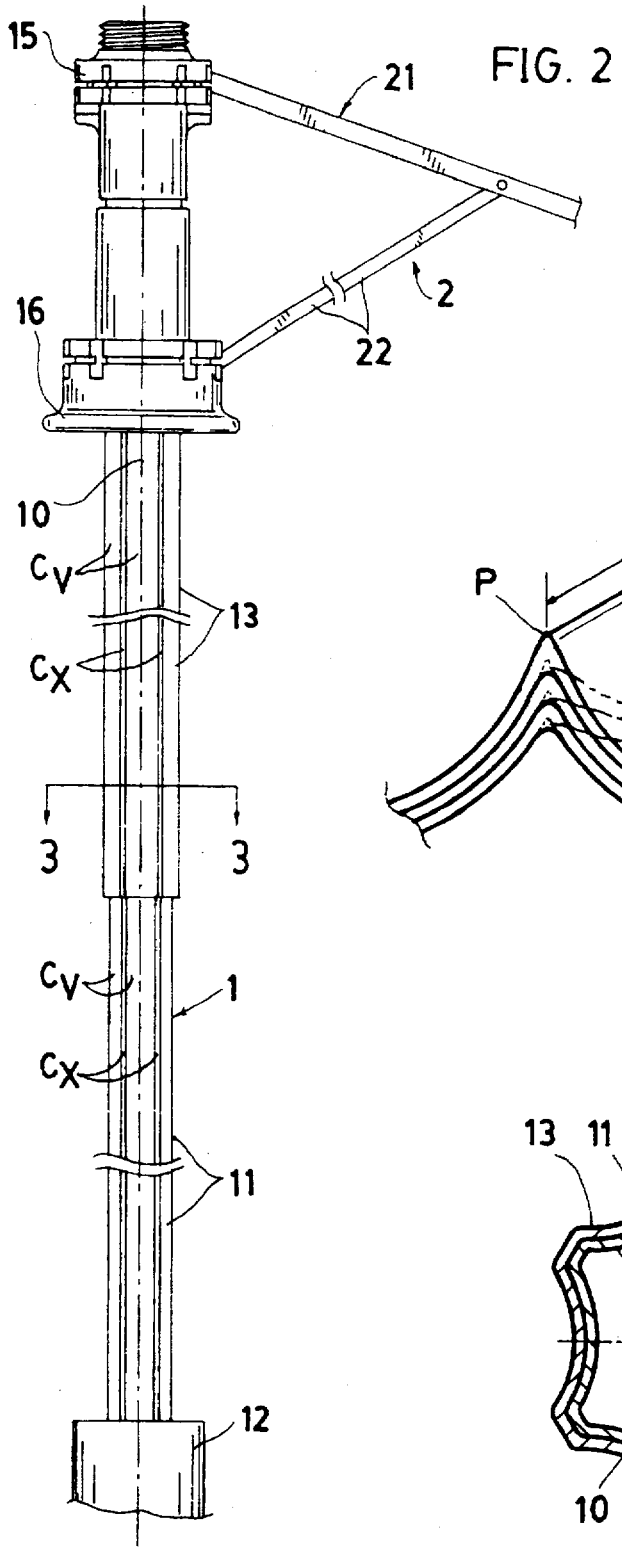
FIG. 2
FIG. 1
PRIOR ART
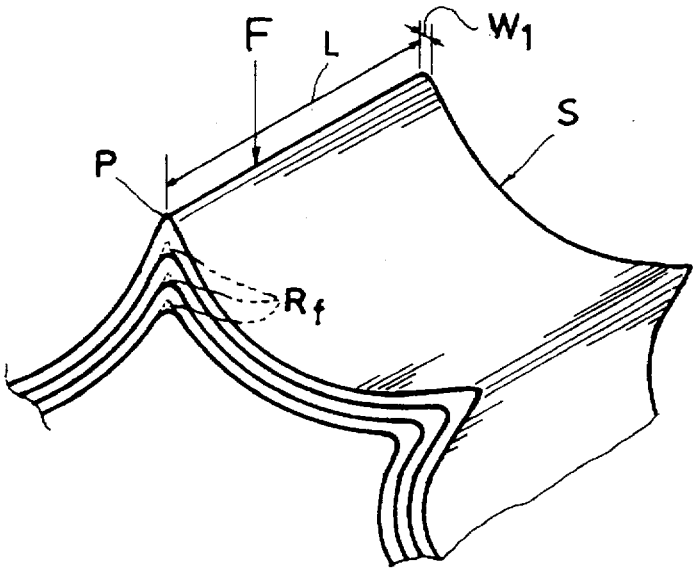
FIG. 3
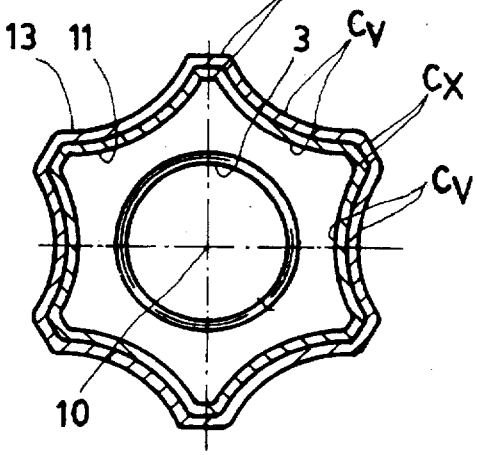

TELESCOPIC UMBRELLA SHAFT MEANS WITH CONCAVE HEXAGONAL SIDES

BACKGROUND OF THE INVENTION

This application is a continuation-in-part (C-I-P) of U.S. Patent Application entitled: "Telescopic Umbrella Shaft Means with Concave Polygonal Sides" (hereinafter called "prior Art") filed: Oct. 07, 1996 with Ser. No. 08/725,823 invented by the same inventors of this application now abandoned.

However, the Prior Art as shown in FIG. 1 has the following drawbacks:

1. Every two neighboring arcuate rectangular sides S converge at an acute ridge P with a narrow width W1, vulnerably attacked by an enternal force F to easily cause deformation or breakage of the umbrella tube to thereby influence a smooth telescopic engagement of an inner (lower) tube with an outer (upper) tube. For instance, the pressure P1 sustained by the ridge portion P for the external force F will be obtained by the following formula:

$$P1=F/(L\cdot W1),$$

wherein L is a length of the tube and the term "L·W1" is a base area subjected to the external force F. Since W1 is a very narrow width, the denominator (L·W1) will become very small in comparison with the numerator (F) to thereby obtain a greater pressure (P1), easily causing deformation of the umbrella tube as aforementioned.

2. In order to prevent deformation at the ridge portion P, the angled portion may be thickened to be a reinforcing thickening portion Rf as shown in FIG. 1. However, the height of the ridge portion of the outermost tube will be greatly increased to form an acute edge portion which may injure the umbrella user when operating or carrying the umbrella.

3. Even though the angled portion between two arcuate sides is reinforced (Rf), the moment of inertia at the reinforcing angled portion (Rf) will be larger than the moment of inertia at the concave portion of each tube side when rotating the central shaft 1 about the longitudinal axis 10 such as for centrifugally removing the rain drops or snow accumulated on the umbrella cloth so that the unbalanced moment of inertia at several portions of the umbrella tube may still twist and deform the tubes of the central shaft, possibly damaging the umbrella.

The present inventors have found the drawbacks of the original application (prior art) and invented the present shaft means having concave hexagonal sides and convex reinforcing ribs for enhancing the strength of the umbrella shaft.

SUMMARY OF THE INVENTION

The object of the present invention is to provide a telescopic umbrella shaft including at least an inner tube, and an outer tube telescopically slidably engageable with the inner tube, with each tube having a cross section of hexagonal shape consisting of six arcuate rectangular sides each arcuate rectangular side concaved inwardly towards a longitudinal axis of the shaft, and every two neighboring arcuate rectangular sides converging to form a reinforcing rib convex outwardly from the longitudinal axis, with each reinforcing rib formed as an inversed-U shape and having a longitudinal strip defining a horizontal plane perpendicular to a normal line between the longitudinal axis and an apex intersected by the two neighboring arcuate rectangular sides of the tube, thereby forming a balanced moment of inertia of the concave and convex parts of the tube when dynamically rotating the central shaft for greatly enhancing the stability and strength of the umbrella shaft.

BRIEF DESCRIPTION OF THE DRAWINGS

FIG. 1 is a partial perspective view of the telescopically engaged tubes of the original application.

FIG. 2 is an illustration of an open umbrella by using the present invention on an umbrella shaft.

FIG. 3 is a cross sectional drawing of the present invention as viewed from 3—3 direction of FIG. 2.

DETAILED DESCRIPTION

Figure 4:
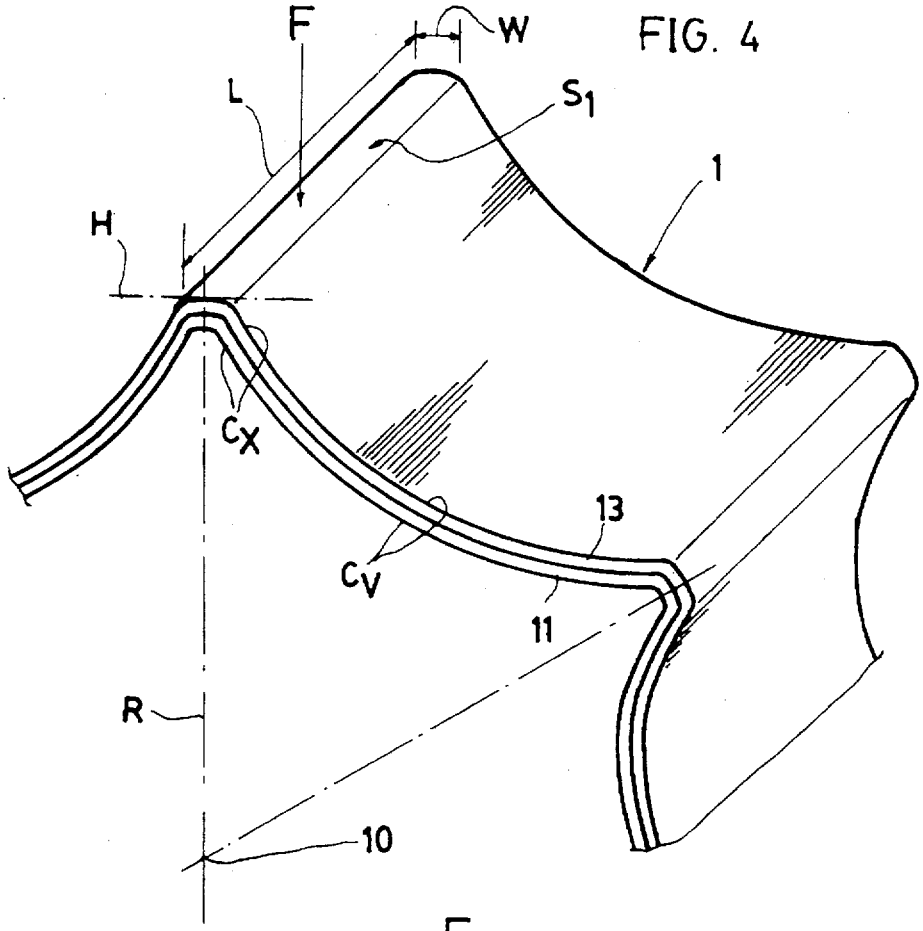
FIG. 4 is an illustration showing the sliding coupling of an inner tube and an outer tube according to the present invention.

As shown in FIGS. 2–5, a telescopic shaft means 1 of the present invention comprises: a central shaft 1 having at least an inner tube 11, an outer tube 13 slidably engageable with the inner tube 11, an upper notch 15 fixed on a top end of the central shaft 1 for pivotally securing a top rib 21 of a rib assembly 2 on the upper notch 15, a runner 16 slidably held on the central shaft 1 for pivotally securing a stretcher rib 22 pivotally connected with the top rib 21 of the rib assembly 2 having an umbrella cloth (not shown) fixed thereon, an opening spring 3 resiliently retained in the central shaft 1 for automatically opening the umbrella, a grip 12 formed on a lower portion of the central shaft 1, and a longitudinal axis 10 defined at a longitudinal center of the central shaft 1.

Each tube 13 or 11 has a cross section of hexagonal shape consisting of six arcuate rectangular sides Cv each side Cv concaved inwardly towards the longitudinal axis 10. Every two neighboring arcuate rectangular sides converge to form a reinforcing rib Cx which is convex outwardly from the longitudinal axis 10.

Each reinforcing rib Cx is formed as an inversed U shape and has a longitudinal strip S1 defining a horizontal plane H on an outermost surface of the longitudinal strip S1 with the horizontal plane H perpendicular to a normal line R between the longitudinal axis 10 and an apex A intersected by the two neighboring arcuate rectangular sides Cv.

Figure 5:
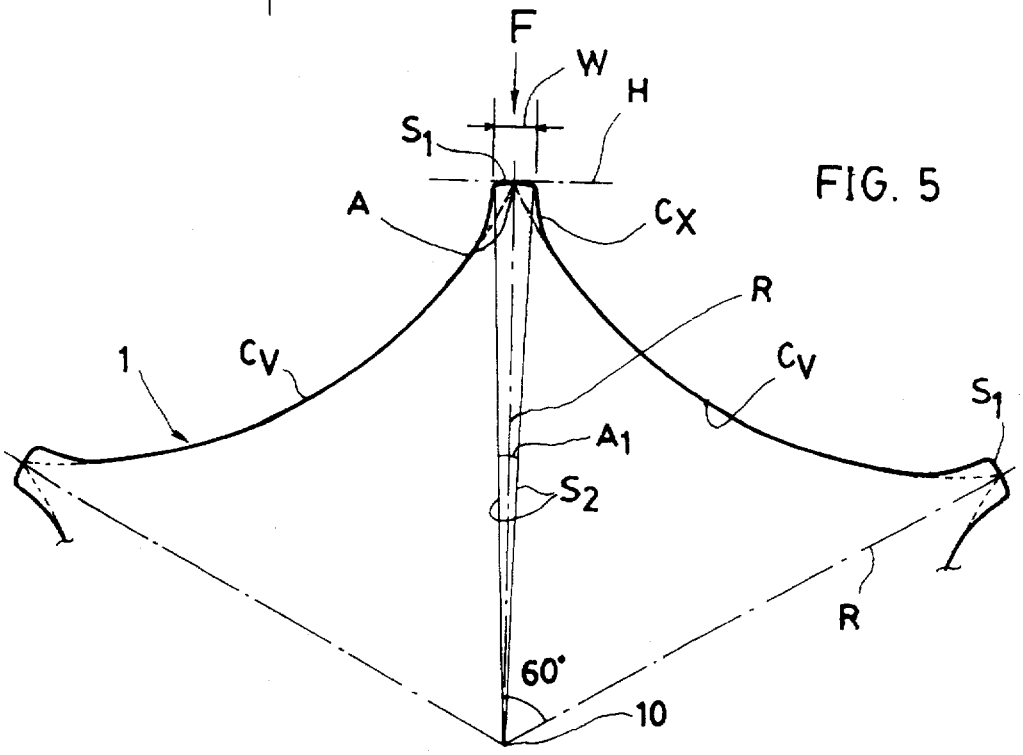
FIG. 5 is an illustration showing the relationship of the concave part and the convex part of the tube according to the present invention.

The longitudinal strip S1 has a width W which forms a chord of a triangle confined among two triangle sides S2, the longitudinal axis 10 and the chord of the width W, with the two triangle sides S2 intersecting at the axis 10 defining an acute angle A1 between the two triangle sides S2 for a range from 5 to 30 degrees (FIG. 5).

Due to the convex reinforcing ribs Cx and the concave arcuate sides Cv juxtapositionally disposed around a circumference of each tube section, the arcuate sides Cv are reinforced by the convex ribs Cx for increasing the strength of the umbrella tubes. Simultaneously, the convex ribs Cx and the concave arcuate sides Cv will form a dynamic balancing configuration or "skeleton" with more uniform moment of inertia at any portion of the tube section to thereby prevent deformation of the umbrella tubes when rotating the umbrella shaft 1 about the longitudinal axis 10.

Therefore, this application (C-I-P) is stronger, more stable, and less deformable than the original application (prior art) of U.S. Ser. No. 08/725,823 early filed: Oct. 07, 1996.

Referring to FIGS. 4, 5 of this application, a longitudinal strip S1 of the convex reinforcing rib Cx of this invention when subjected to an external impact force F, will sustain a pressure p on a basic unit area of a width W of the strip S1 timing the length L of the strip S1 as calculated by the following formula:

$$p=F/(L.W)$$

$$p=F/(L.W)$$

Since W of this invention is greatly wider than the narrower width W1 of the ridge portion P of the original application (FIG. 1), the area of L·W of this invention is greater than that of the prior art so that the pressure p of this invention will be greatly reduced to minimize the deformation or breakage on the ribs Cx of the umbrella tubes 13, 11 for further enhancing the strength and stability of this invention, being much improved over the prior art of the earlier application of U.S. Ser. No. 08/725,823.

Meanwhile, the flattened strip S1 of the convex reinforcing rib Cx of this invention provides a flat smooth outer surface of the umbrella tubes without injuring the umbrella user for safer operation, uses and carrying of the umbrella.

Figure 6:
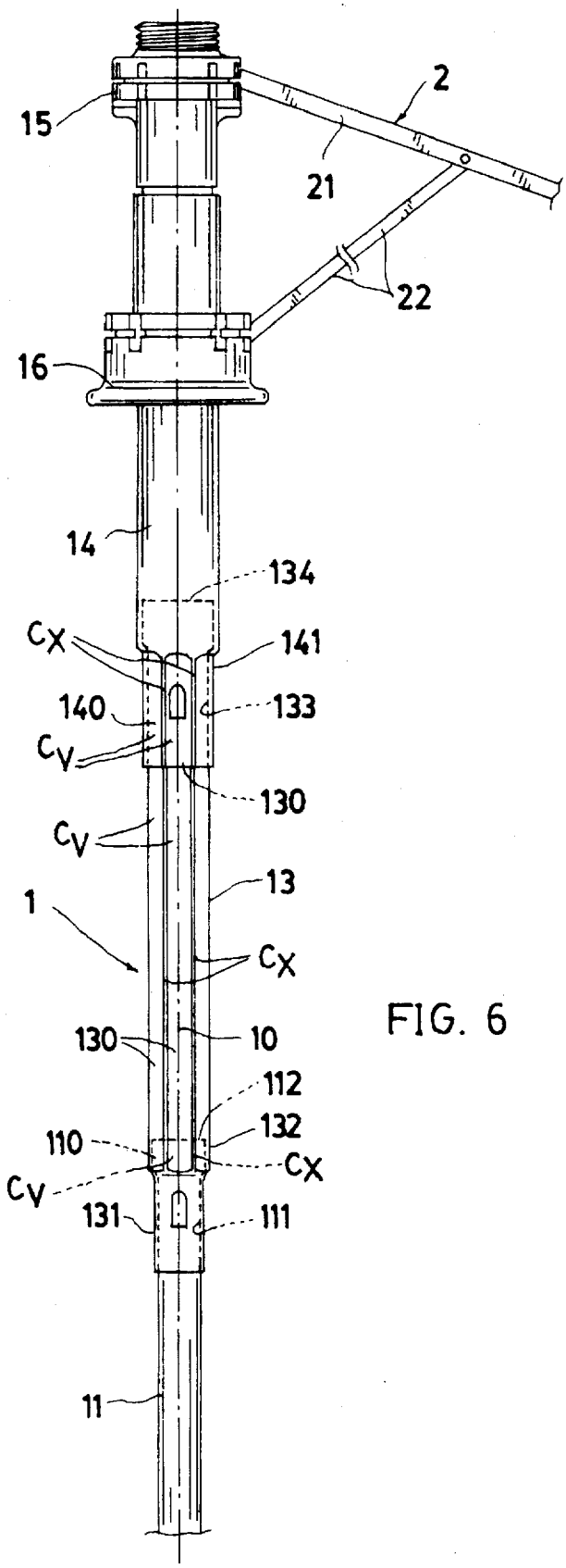
FIG. 6 shows another umbrella shaft of triple folds in accordance with the present invention.

As shown in FIG. 6, the present invention may also be used for triple-fold umbrella having a lower tube 11, a middle tube 13, and an upper tube 14 telescopically slidably engageable with one another; adapted for making an automatic umbrella or an umbrella not automatically operated.

The middle tubes 13 is a hexagonal tube having six arcuate sides 130 concaved inwardly (Cv) towards the axis 10, and six convex reinforcing ribs Cx each rib Cx juxtapositional to each concave arcuate side Cv, and further including: a lowest cylindrical tube portion 131 tapered downwardly from a lower hexagonal tube portion 132 having a cross section of hexagonal shape, an upper hexagonal tube portion 133 formed on an upper portion of the middle tube 13, and an uppermost cylindrical tube portion 134 enlarged upwardly from the upper hexagonal tube portion 133, with the lowest cylindrical tube portion 131 slidably engageable with an uppermost hexagonal tube portion 112 enlarged upwardly from an upper cylindrical tube portion 111 of the lower tube 11.

The upper tube 14 includes a lowest hexagonal tube portion 141 tapered downwardly from a lower cylindrical tube portion 142 of the upper tube 14 and slidably engageable with the upper hexagonal tube portion 133 of the middle tube 13, with the lowest hexagonal tube portion 141 consisting of six arcuate rectangular sides 140 defining the hexagonal tube portion 141 each rectangular side 140 concaved (Cv) inwardly towards the longitudinal axis 10 of the shaft means 1, and each arcuate side 140 juxtaposed with a convex reinforcing rib Cx.

The lower tube 11 includes the upper cylindrical tube portion 111 formed on an upper portion of the lower tube 11 and an uppermost hexagonal tube portion 112 enlarged upwardly from the upper cylindrical tube portion 111, with the uppermost hexagonal tube portion 112 consisting of six arcuate rectangular sides 110 defining the hexagonal tube portion 112, each rectangular side 110 concaved (Cv) inwardly towards the longitudinal axis 10 of the central shaft 1, and each side 110 juxtapositioned with a convex reinforcing rib Cx.

The present invention may be modified without departing from the spirit and scope of this invention. This invention may be made for multiple folds, not limited.

I claim:

1. An umbrella telescopic shaft means comprises:

at least an inner tube, and an outer tube telescopically slidably engageable with the inner tube about a longitudinal axis defined at a longitudinal center of said tubes;

each said tube having a cross section of hexagonal shape consisting of six arcuate rectangular sides each said rectangular side concaved inwardly towards the longitudinal axis; and each said tube having two neighboring arcuate rectangular sides converging convexly to form a reinforcing rib which is convex outwardly from the longitudinal axis, each said reinforcing rib formed as an inversed U shape and including a longitudinal strip having a horizontal plane formed on an outermost surface of the longitudinal strip, said horizontal plane being perpendicular to a normal line defined between the longitudinal axis and an apex intersected by the two neighboring arcuate rectangular sides.

2. An umbrella telescopic shaft means according to claim 1, wherein said longitudinal strip has a width which forms a chord of a triangle confined among two triangle sides, the longitudinal axis and the chord of the width, with the two triangle sides intersecting at the axis defining an acute angle between the two triangle sides for a range from 5 to 30 degrees.

* * * * *